United States Patent [19]

Dunbar

[11] Patent Number: 4,538,764

[45] Date of Patent: Sep. 3, 1985

[54] METHOD AND APPARATUS FOR PROVIDING FINELY DIVIDED POWDER

[76] Inventor: Richard M. Dunbar, 7448 Lyndale Ave. S., Ste. 210, Bloomington, Minn. 55420

[21] Appl. No.: 510,089

[22] Filed: Jun. 30, 1983

[51] Int. Cl.[3] ..... B02C 19/06

[52] U.S. Cl. ..... 241/5; 241/39

[58] Field of Search ..... 241/48, 52, 97, 53, 241/62, 80, 5, 39, 81

[56] References Cited

U.S. PATENT DOCUMENTS 2,636,688 4/1953 Singh ..... 241/5 X 3,186,648 6/1965 Mandle et al. ..... 241/5 X

*Primary Examiner*—Mark Rosenbaum

*Attorney, Agent, or Firm*—Kinney & Lange

[57] ABSTRACT

A no-moving parts pulverizer and classifier system reduces carbonaceous materials to one hundred fifty microns to less than ten microns using superheated steam or any gas capable of being compressed and expanded thru machined orifices. The resultant size reduction depends upon the classifier gas rate and pressure, the pulverizer gas rate and its pressure. These combinations control and regulate maximum particle size, average particle size and the mix of gas and solids in process. The feedstock enters the classifier chamber by auger or similar as long as the feeder maintains a positive seal. The classifier chamber separates the feedstock by size and particles of a predetermined size exit the system in a specific ratio of gas and solids. The feedstock larger than specified exit the base of the classifier, split into two equal streams and accelerate thru the pulverizer. The reduced feedstock exits the pulverizer, mixes with incoming feedstock and again enters the classifier. The system is controlled using pressure, temperature, feedrate or any combination of the three. Other control methods can be used in any one of the three are part of the control circuit.

12 Claims, 4 Drawing Figures

METHOD AND APPARATUS FOR PROVIDING FINELY DIVIDED POWDER

The present invention relates to methods and apparatus for pulverizing and for the provision of material in finely divided form. More particularly, the present invention relates to a method and apparatus for pulverizing coal and to coordinate the coal grinding with furnace demand for fuel.

A wide variety of types of pulverizing methods and classifying apparatus have been proposed in the past. Certain of these have utilized fluid energy to effect the pulverizers. of these, the most effective have been pulverizers of the type wherein material in the form of large granules are thrown against a plate or wall and broken-up by impact, and pulverizers in which particles are thrown toward each other by two or more connverging streams. Impact pulverizers are, however, subject to the difficulties that the plate wears out rapidly, that often the plate material becomes undesirably entrained with the material being pulverized, and that the pulverization for the most part is undesirably coarse for many desired uses.

Coal, owing to the content of pyrites and other abrasive impurities has always been difficult to grind, especially to particle sizes in the ten micron (ultrafine) range.

The power industry has recognized that it has been advantageous to produce ultrafine coal so as to improve the coal's efficiency as a fuel. Coal would burn more completely, yield more heat and produce more manageable ash. The power industry has always sought a practical and effective attrition mill, rather than one in which coal is broken by moving parts which are subject to rapid and severe wear. Such attrition mills would ideally break the coal by a process, comminution, which means to rub, grind or thrash to pieces.

The present invention relates to a method and apparatus for obtaining powders having a fineness which can be utilized in different industries. The present invention has enabled the provision of a large number of materials in the form of powders much finer than could be produced by previous commercial apparatuses and procedures, and has made possible an extraordinarily efficient production of fine powders. In accordance with the invention, many materials hereinbefore considered difficult or impossible of commercial production in the form of fine powders can be readily produced in finely powdered form by means of the invention.

The invention contemplates the effectuation of pulverization by the use of fluid pressure in a highly efficient manner and that the material may be classified in a thorough and efficient manner. Preferably there is provided a procedure and means whereby both a highly efficient pulverization and a highly efficient classification is obtained.

In accordance with the present invention there is provided means for grinding particles such as graphite, talc, chalk and other soft substances, especially coal, by colliding particles against each other. Preferably, at least two high-pressure opposed jets of fluid-borne particles are fired at each other, creating millions of collisions which break the particles in the process of attrition or comminution. The fluid stream carries the particles to a classifier which sorts and removes the desired fraction for use and returns the rest for regrinding.

An object of the inventon is the provision of a method and apparatus whereby a wide variety of solid materials may be readily provided in the form of a fine powder.

Another object is the provision of improved method and means for continuously breaking up particles of material.

Among the specific objects of the invention are the provisions of methods and means whereby coal, having a maximum or average particle size which is about 10 microns, may be readily obtained in quantity for use as a fuel source.

The apparatus of the present invention includes a classifier in the form of a cyclone which forms a gaseous vortex so as to separate particulates by driving coarser particles outwardly. In accordance with a preferred feature of the present invention, the operation of the classifier is adjustable so as to make the system compatible with the operating facilities of a power plant or other large fuel users. It is preferably designed so that either boiler or furnace controls can govern the rate of feed of coal required. Therefore, the present invention contemplates that in power plants, coal grinding is coordinated with furnace demand for fuel. When furnace demand increases, the system tolerates a brief burst of coarse mix so that constant fuel flow continues and no loss of furnace flame occurs. When furnace demand drops, the pulverizing means recirculates coal to produce a finer grind and avoids fuel overload at the furnace. Means may be also additionally provided to unload coal from the pulverizing means for safe storage if the furnace shuts down.

In accordance with the present invention there may be provided means for signalling interlocks which prevent any malfunction and, additionally, means for signalling maintenance.

In accordance with a specific feature of the invention, there is provided an apparatus and method of providing materials in finely divided form, which includes the steps of (a) forming a first fluid stream under high velocity having particulate matter entrained therein;

(b) forming a constant gaseous vortex in a first zone by combining a second high velocity gas stream with said first fluid stream so as to separate particulates by driving coarser particles outwardly;

(c) withdrawing fluid and entrained fine particles upwardly in a manner so as to maintain rotational movement of the fluid and the entrained particles;

(d) passing coarser entrained particles and fluid downwardly to a second zone having a multiplicity of streams of high velocity fluids so as to combine the fluids and cause impingement of particles moving at high speeds, and then (e) withdrawing fluid having particles entrained therein from said second zone so as to comprise said first fluid stream of (a).

Preferably, the speed of the vortex is higher than the speed of the first fluid stream and there is included means for controlling the velocity of the second gas stream. Through the provisions of the invention the fluid and fine particles are withdrawn from the first zone upwardly through an outlet and to a storage area or power plant as a fuel source and the entrained coarse particles are moved downwardly into the second zone for regrinding.

For a fuller understanding of the nature and objects of the invention, reference should be had to the following detailed description taken in connection with the accompanying drawings in which.

Figure 1:
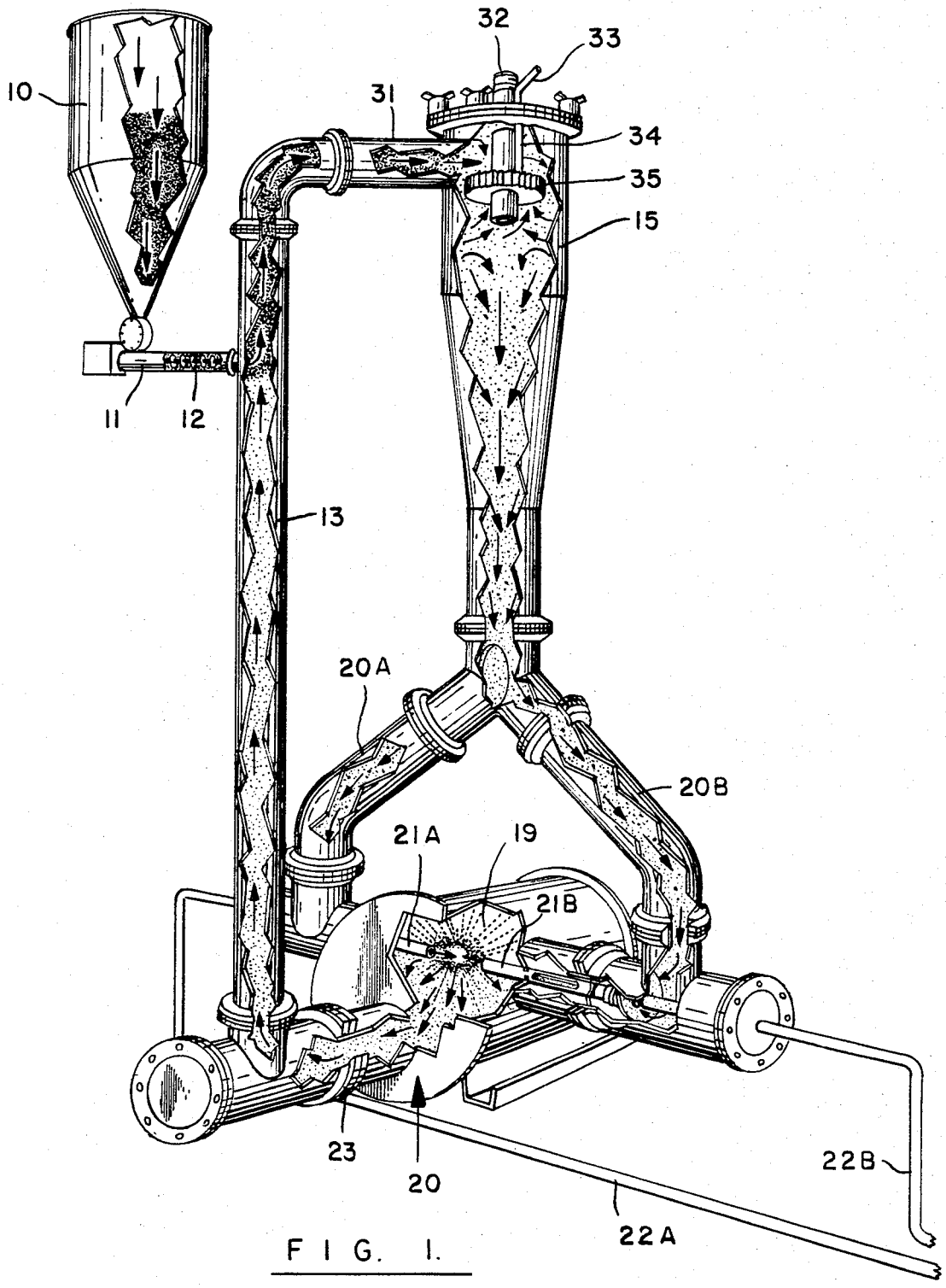
FIG. 1 is a diagrammatic view of the system of the present invention.
Figure 2:
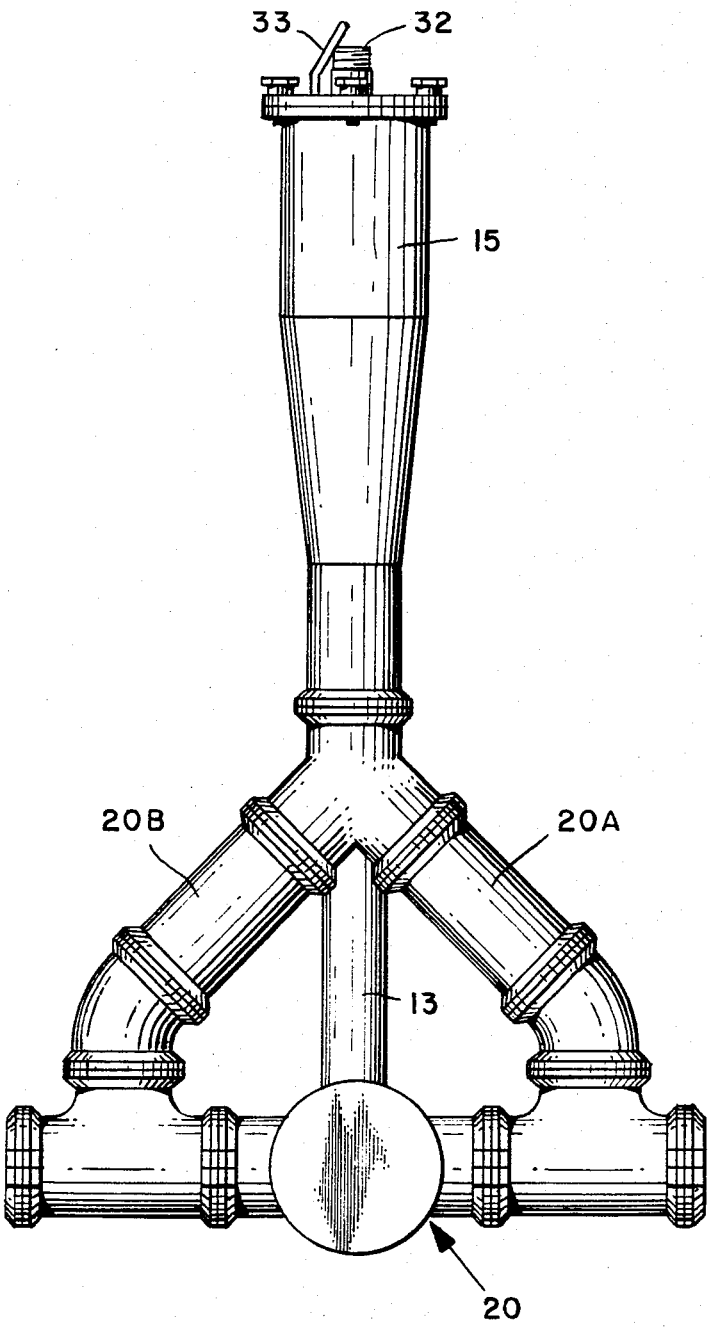
FIG. 2 is a front view of the system of FIG. 1.
Figure 3:
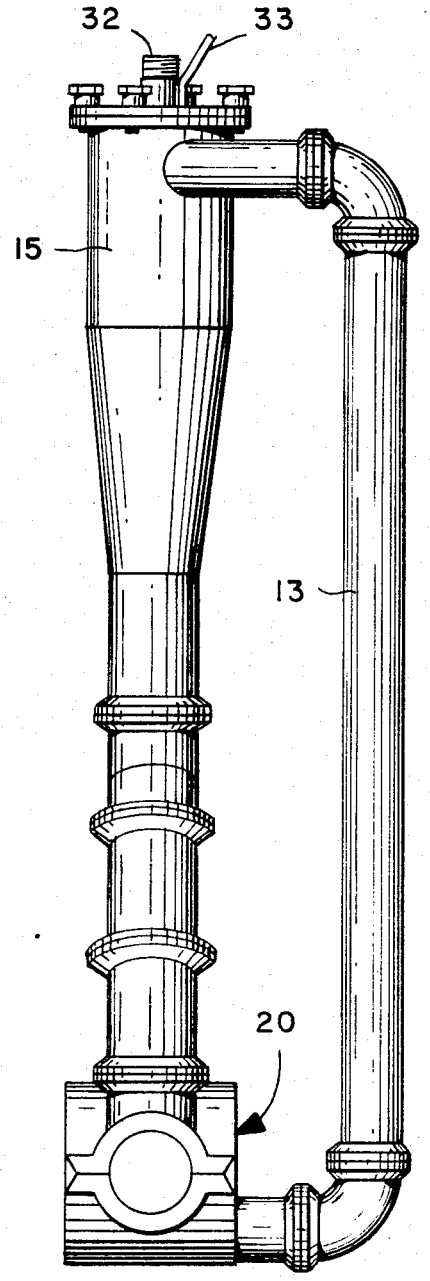
FIG. 3 is a side view of the system of FIG. 1.

As shown in FIGS. 1–3, there are utilized certain combinations or subcombinations of steps under various conditions whereby one or more of the highly advantageous results sought may be readily obtained.

The feed powder, which may be chalk, talc, coal and the like, is placed into a feed stock reservoir 10 and passed through line 11 by a known means, such as a helical screw 12, into line 13 wherein gaseous fluid carries the powder into classifying means 15. The classifying means, which will be hereinafter described in greater detail, sorts the powder particles, removing the particles of a desired size, such as coal for use as a fuel, and returns the other coarse particles into a stream for grinding.

The powders enter a comminution or pulverization zone 20 by means of feed lines 20A and 20B.

The pulverization zone comprises a chamber 19 having a pair of opposing nozzles 21A and 21B wherein the feed from lines 20A and 20B are introduced together with streams of high-speed gaseous fluid from lines 22A and 22B so as to impinge upon each other. The fluid streams are introduced into the pulverization zone 20 at such a high velocity as to exert a breaking or tearing effect on the particles as they impinge on other particles (or upon the walls of the pulverizaton zone 20). Also, because of the high relative movement of the fluid, undesirably large particles are thrown or bounced into, or otherwise reach the inner portion of the zone 20. Two or more streams of gaseous fluid makes it possible for a large number of particles to keep moving in a variety of different directions so as to impinge upon each other at a high speed and with great breaking or tearing effect.

A considerable amount of pulverization and a considerable amount of classification will always be obtained in accordance with the invention, regardless of the particular procedure or apparatus in which the invention is embodied, but it is not essential for a number of purposes that a highly efficient pulverization and highly effective classification be both obtained. Highly improved pulverization, highly improved classification, or both, may be obtained in accordance with the invention.

The gaseous fluid which is introduced into the pulverization zone 20 by means of nozzles 21A and 21B from lines 20A and 20B carries entrained particles out of the pulverization zone through outlet 23 into the feed line 13. The high velocity movement is maintained as a result of the high energy being introduced from lines 22A and 22B. In line 13, the fluid and particles are combined with fresh feed stock and enter the classifier 15 for removal of desired particles and recycling of larger particles for further pulverization.

Material may be supplied substantially continuously during continued operation but a certain amount of pulsation in the feed will ordinarily not be harmful so long as the supply at any time is not sufficiently great, and so long as the intervals between the intermittent supply of materials are not sufficiently large so that substantial variations in the circulating load will occur.

The velocity of the introduced streams may vary considerably but should be of a high order. Such velocities are ordinarily obtained by applying high-pressure fluid to the nozzles to release a gaseous fluid, for instance, as steam or air, or inert gases through the jet opening of the nozzle. In an operation where coal is to be pulverized to particle sizes in the ten micron (ultrafine) range, it has been found suitable to introduce as the high energy fluid steam under a pressure of 90 pounds per square inch at a temperature of 750° F.

Figure 4:
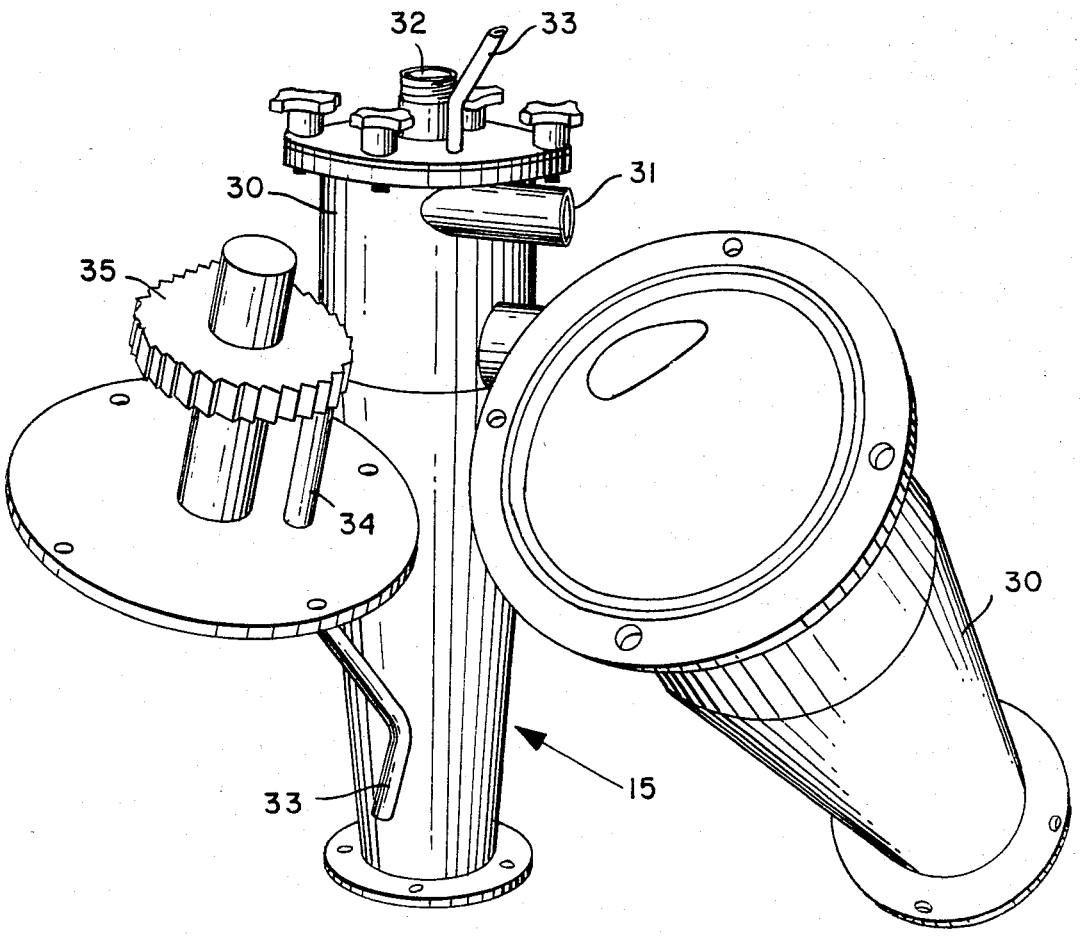
FIG. 4 is a broken apart view of the classifier of FIG. 1.

As shown in FIG. 4, the classifying means 15 comprises a mechanical cyclone having a cyclone tube 30, an inlet 31, an outlet 32, a secondary gas flow inlet 33, a gas nozzle 34, and a hub 35. In operation of the classifier, gas-conveyed particulates enter the cyclone tube axially or tangentially through inlet 31. A secondary gas from an independent source enters the gas nozzle 34 and acts to provide a large number of essentially tangential fluid jets for the purposes of inducing a constant, controlled vortex in the cyclone tube. As in conventional cyclones, particulates are acted upon by an outwardly directed centrifugal force which separates the particles according to aerodynamic diameter. The separated solids having the larger aerodynamic diameters are carried downward while the finer particles which are insufficiently affected by the vortex flow reverse direction in the lower part of the cyclone tube and exit through outlet 32. Unlike conventional cyclones, which use tangential inlets or vanes for the primary (particle-bearing) gas flow to create a vortex, the present classifier provides significantly greater fine particle separation efficiency at high continuous throughputs. This high efficiency is maintained over a wide range of primary gas flows and solid loadings. It can be seen that controlling the flow of secondary gas also controls the speed of rotation of separation vortex, largely independently of the primary gas flow.

The pressure drop in the system is controlled by the secondary flow which is also an effective disperser. Use of the classifier of the present invention has been found to produce a high efficiency over a wide range of primary gas flows and solids loadings without the problems of plugging.

It can therefore be seen that a critical feature in the classifier of the present invention is the secondary gas nozzle assembly which imposes a vortex on the primary gas flow. This gas jet action separates particulates from the gas stream and prevents solids build-up on tube surfaces and eliminates system plugging.

In the system of the present invention, one or more classifiers may be utilized with a common inlet and outlet and discharging of the collected solids into one or more closed hoppers.

The secondary gas range is preferably 15–20% of the primary air flow at 3–7 psig or 7–10% at 15 psig.

In the inner zone of the vortex, the material is classified by the centrifugal action of the vortex and all particles greater than a desired size (which may be exceedingly small) are returned to the outer zone by the centrifugal action. The classification of material in this zone results in only the smallest particles being carried over with the fluid through the outlet. In the classification zone an exceedingly effective classification is secured since the high-speed rotation of the vortex continues as the vortex spirals inwardly toward the outlet opening and there is no possibility for batches of the material to build-up or otherwise work back so as to ultimately overload the vortex and interfere with the classifying action.

Air, steam or any other suitable gaseous fluids may be utilized as the secondary gas, which may be at any desired temperature. Ordinarily, the secondary gas stream or streams is the same as the primary gaseous fluid.

It will thus be seen that these may be provided in accordance with the prevalent invention procedures and constructions which vary considerably, but which contain fundamental and novel inventive concepts whereby highly desirable results may be obtained in an efficient manner.

Since certain changes in carrying out the above method and in the constructions set forth, which embody the invention may be made without departing from its scope, it is intended that all matters contained in the above description or shown in the accompanying drawings shall be interpreted as illustrative and not in a limiting sense.

What is claimed is:

1. The method of providing materials in finely divided form, which comprises forming a first fluid stream under high velocity having particulate matter entrained therein;

forming a constant gaseous vortex by a second gas steam with said first fluid stream in a first zone so as to separate particulates by driving coarser particles outwardly;

withdrawing fluid and entrained fine particles from said first zone upwardly in a manner so as to maintain rotational movement of the fluid and the entrained particles;

passing coarser entrained particles and fluid downwardly to a second zone having a multiplicity of streams of high velocity fluids so as to cause impingement of particles moving at high speeds, and withdrawing fluid having particles entrained therein from said second zone so as to comprise said first fluid stream.

2. The method of claim 1 wherein the speed of the vortex is higher than the speed of said first fluid stream.

3. The method of claim 1 including feeding additional particulates into said first fluid stream.

4. The process of claim 1 including controlling the velocity of said second gas stream so as to regulate the vortex.

5. The process of claim 1 wherein the fluid and fine particules are withdrawn upwardly through an outlet in said first zone and the entrained coarse particles are withdrawn downwardly to said second zone.

6. The process of claim 1 wherein said particulates are coal.

7. The process of claim 1 wherein said first fluid stream is steam.

8. An apparatus for providing material in finely divided form comprising a vortex chamber, said chamber comprising a housing having an inlet means and an outlet means at its upper portion and a solids discharge means at its lower portion, a nozzle assembly mounted about the outlet portion of said housing, said nozzle assembly comprising a hub and gas nozzles which cause a high velocity gaseous fluid to create a vortex; means connected to said inlet for supplying material to a vortex in said chamber; means associated with said outlet to withdraw fine particulates and gaseous fluid, a pulverization chamber comprising a housing having means for supplying a multiplicity of high velocity fluid streams so as to cause impingement of particles therein moving at high speed for pulverization action, means associated with said solids discharge means for supplying material into said velocity streams in said pulverization chamber, and means for withdrawing fluid and particles from said pulverization chamber to said vortex chamber.

9. The apparatus of claim 8 including means for feeding additional material to the fluid withdrawn from said pulverization chamber.

10. The apparatus of claim 8 wherein said pulverization chamber comprises a housing having a pair of inlets, each inlet being associated with a source of high velocity fluid and having at least one nozzle assembly wherein the high velocity fluid is combined with a portion of the stream discharged from said vortex chamber and supplied into said pulverization chamber, each nozzle assembly being arranged to cause direct impingement of the fluids discharged from each nozzle assembly, and outlet means for discharging fluid and material from said pulverization chamber.

11. The apparatus of claim 8 including means for controlling secondary gas flow.

12. The apparatus of claim 8 including a source of high velocity steam.

* * * * *